US011044964B2

(12) United States Patent
Meeker

(10) Patent No.: US 11,044,964 B2
(45) Date of Patent: Jun. 29, 2021

(54) FOOTWEAR SOLE STRUCTURE WITH BLADDER

(71) Applicant: NIKE, Inc., Beaverton, OR (US)

(72) Inventor: Jason R. Meeker, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 9 days.

(21) Appl. No.: 16/419,284

(22) Filed: May 22, 2019

(65) Prior Publication Data

US 2019/0365036 A1 Dec. 5, 2019

Related U.S. Application Data

(60) Provisional application No. 62/678,251, filed on May 30, 2018.

(51) Int. Cl.

| | |
|---|---|
| ***A43B 13/20*** | (2006.01) |
| ***A43B 5/00*** | (2006.01) |
| ***A43B 13/22*** | (2006.01) |
| ***A43C 15/16*** | (2006.01) |
| ***A43D 25/00*** | (2006.01) |
| ***A43B 13/12*** | (2006.01) |

(52) U.S. Cl.

CPC ..... *A43B 13/20* (2013.01); *A43B 5/00* (2013.01); *A43B 13/12* (2013.01); *A43B 13/223* (2013.01); *A43C 15/161* (2013.01); *A43D 25/00* (2013.01)

(58) Field of Classification Search

CPC ..... A43B 13/20; A43B 13/12
USPC ..... 36/29, 76 R, 107
See application file for complete search history.

(56) References Cited

U.S. PATENT DOCUMENTS

| | | | | |
|---|---|---|---|---|
| 4,183,156 | A | 1/1980 | Rudy | |
| 4,219,945 | A * | 9/1980 | Rudy | A43B 13/203 36/29 |
| 4,936,029 | A | 6/1990 | Rudy | |
| 4,999,931 | A * | 3/1991 | Vermeulen | A43B 13/185 36/153 |
| 5,042,176 | A | 8/1991 | Rudy | |
| 5,842,291 | A * | 12/1998 | Schmidt | A43B 13/20 36/29 |
| 6,013,340 | A | 1/2000 | Bonk et al. | |

(Continued)

FOREIGN PATENT DOCUMENTS

| | | | |
|---|---|---|---|
| KR | 200400222 | Y1 | 11/2005 |
| WO | 9809546 | A1 | 3/1998 |

(Continued)

*Primary Examiner* — Marie D Bays
(74) *Attorney, Agent, or Firm* — Quinn IP Law

(57) ABSTRACT

A sole structure includes a midsole layer with a lower surface having a first recess that has an outer periphery spaced inward of an outer periphery of the midsole layer, and a peripheral bonding region between the outer periphery of the midsole layer and the outer periphery of the first recess. A sole plate has an upper surface with a second recess forming a cavity with the first recess between the sole plate and the midsole layer. The upper surface of the sole plate has a peripheral bonding region between an outer periphery of the sole plate and an outer periphery of the second recess. A bladder nests in the cavity with a contoured upper surface inward of the peripheral bonding region of the midsole layer and a contoured lower surface inward of the peripheral bonding region of the sole plate. A method of manufacturing the sole structure is disclosed.

20 Claims, 9 Drawing Sheets

(56) References Cited

U.S. PATENT DOCUMENTS 6,082,025 A 7/2000 Bonk et al.
6,127,026 A 10/2000 Bonk et al.
6,203,868 B1 3/2001 Bonk et al.
6,321,465 B1 11/2001 Bonk et al.
6,453,577 B1 * 9/2002 Litchfield ..... A43B 13/203 36/29
6,505,420 B1 * 1/2003 Litchfield ..... A43B 13/203 36/28
6,745,499 B2 * 6/2004 Christensen ..... A43B 13/20 36/29
6,754,981 B1 * 6/2004 Edwards ..... A43B 7/144 36/29
7,588,654 B2 9/2009 Schindler et al.
7,591,919 B2 9/2009 Schindler et al.
7,748,142 B2 * 7/2010 Fusco ..... A43C 15/168 36/28
8,056,267 B2 11/2011 Auger et al.
8,470,113 B2 * 6/2013 Beye ..... A43B 13/20 156/145
8,782,924 B2 * 7/2014 Peyton ..... A43B 13/206 36/29
8,973,290 B2 * 3/2015 Howley ..... A43C 15/167 36/126
8,984,775 B2 * 3/2015 Dombrow ..... A43B 23/0295 36/102
9,226,548 B2 1/2016 Follet et al.
9,730,487 B2 8/2017 Davison
2003/0019128 A1 * 1/2003 Litchfield ..... A43B 13/203 36/29
2004/0154189 A1 * 8/2004 Wang ..... A43B 13/026 36/28
2005/0097777 A1 5/2005 Goodwin
2005/0278980 A1 * 12/2005 Berend ..... A43B 23/087 36/103
2006/0010717 A1 1/2006 Finkelstein
2006/0225304 A1 10/2006 Goodwin
2006/0230636 A1 * 10/2006 Kokstis ..... A43B 21/28 36/35 B
2010/0251567 A1 * 10/2010 McInnis ..... A43B 13/203 36/29
2011/0277347 A1 * 11/2011 Monfils ..... A43B 13/189 36/29
2011/0277916 A1 * 11/2011 Beye ..... B32B 3/06 156/145
2012/0159814 A1 * 6/2012 Smith ..... A43B 13/12 36/92
2012/0216943 A1 8/2012 Rapaport et al.
2012/0260524 A1 * 10/2012 Izquieta Anaut .... B29D 35/142 36/28
2015/0113829 A1 4/2015 Kodad
2016/0081428 A1 3/2016 Swigart et al.
2016/0143392 A1 5/2016 Peyton et al.
2016/0324259 A1 11/2016 Berend et al.
2017/0079373 A1 * 3/2017 Huard ..... A43B 13/122
2017/0265595 A1 9/2017 Hatfield et al.
2018/0064207 A1 3/2018 Hurd et al.
2018/0064208 A1 3/2018 Hurd et al.
2018/0332924 A1 * 11/2018 Bailey ..... B29D 35/142
2018/0332925 A1 * 11/2018 Bailey ..... B29D 35/122
2018/0338575 A1 * 11/2018 Elder ..... A43B 13/145
2018/0338577 A1 * 11/2018 Elder ..... A43B 13/145
2018/0338578 A1 * 11/2018 Elder ..... A43B 3/0052
2019/0365036 A1 * 12/2019 Meeker ..... A43B 13/223
2019/0365039 A1 * 12/2019 Auyang ..... A43B 13/40
2020/0154825 A1 * 5/2020 Case ..... A43B 13/188
2020/0154826 A1 * 5/2020 Case ..... A43B 13/203
2020/0281316 A1 * 9/2020 Bailey ..... A43B 13/04

FOREIGN PATENT DOCUMENTS

WO 2010057207 A2 5/2010
WO 2015145329 A1 10/2015
WO 2017053654 A1 3/2017

* cited by examiner

FOOTWEAR SOLE STRUCTURE WITH BLADDER

CROSS-REFERENCE TO RELATED APPLICATIONS

This application claims the benefit of priority to U.S. Provisional Application No. 62/678,251, filed May 30, 2018 which is incorporated by reference in its entirety.

TECHNICAL FIELD

The present teachings generally relate to a sole structure for an article of footwear.

BACKGROUND

Footwear typically includes a sole structure configured to be located under a wearer's foot to space the foot away from the ground. Sole structures may typically be configured to provide one or more of cushioning, motion control, and resiliency.

DESCRIPTION

Figure 1:
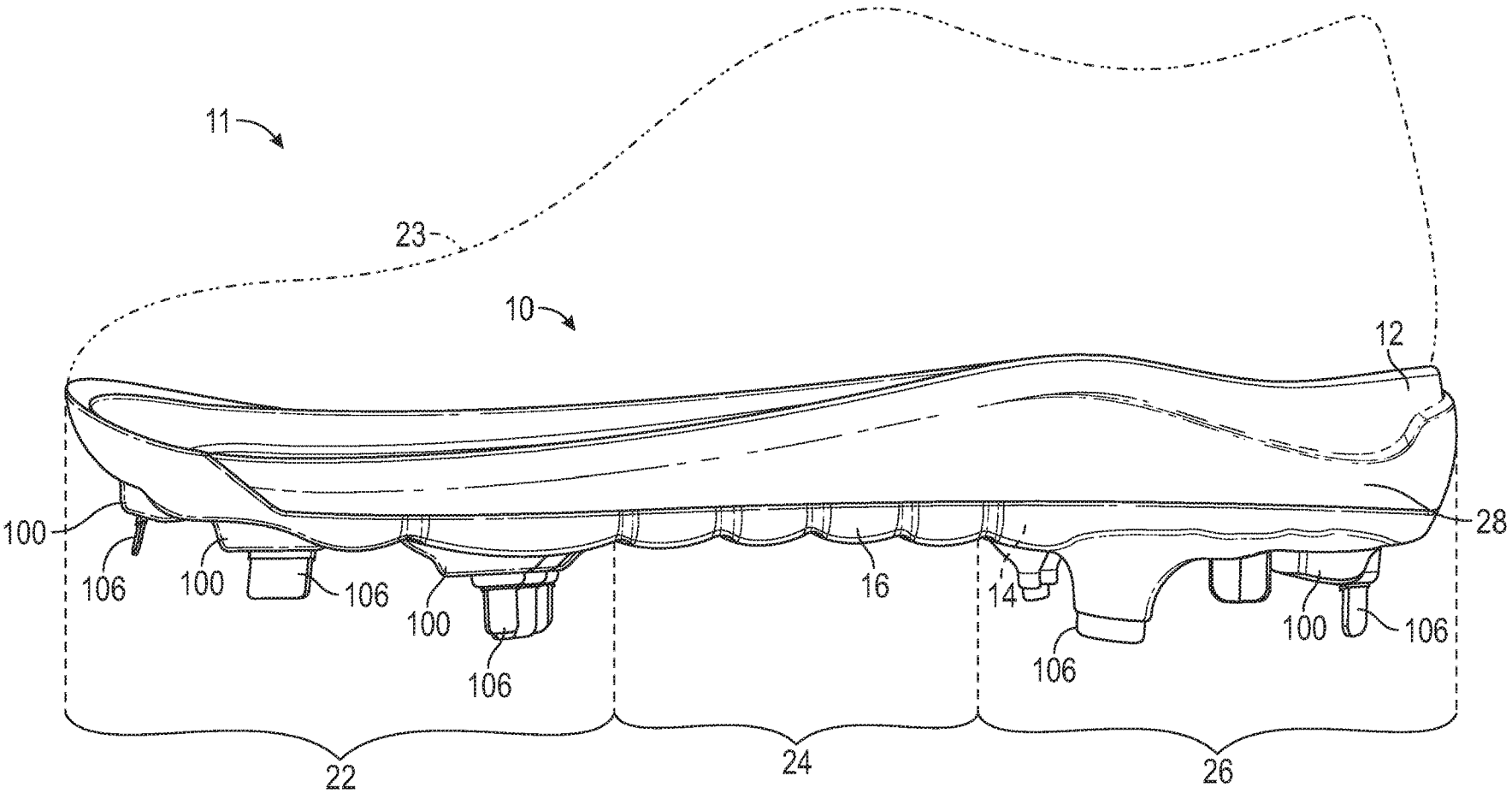
FIG. 1 is a schematic illustration in lateral side view of a sole structure.

An inflated bladder may have contoured surfaces near its outer periphery in order to provide desired cushioning characteristics, responsiveness, and/or motion control. Bonding to the contoured surfaces presents greater manufacturing challenges than does bonding to relatively flat surfaces. A sole structure for an article of footwear provided herein has an interfitting bladder, midsole layer and sole plate that stack together to capture the bladder between the midsole and the sole plate, achieving a secure bond at the periphery of the sole structure while accommodating even the contoured surfaces of the bladder near the outer periphery of the bladder. Additionally, the sole structure may provide staged cushioning with different cushioning characteristics in different regions of the sole structure.

A sole structure for an article of footwear may comprise a midsole layer, a sole plate, and a polymeric bladder. The midsole layer may have a lower surface with a first recess and a peripheral bonding region between an outer periphery of the midsole layer and an outer periphery of the first recess. The outer periphery of the first recess may be spaced inward of the outer periphery of the midsole layer. The sole plate may have an upper surface with a second recess. The first recess and the second recess may together form a cavity between the sole plate and the midsole layer. The upper surface of the sole plate may have a peripheral bonding region between an outer periphery of the sole plate and an outer periphery of the second recess. The polymeric bladder may be nested in the cavity between the midsole layer and the sole plate with a contoured upper surface of the polymeric bladder inward of the peripheral bonding region of the midsole layer and a contoured lower surface of the polymeric bladder inward of the peripheral bonding region of the sole plate. Because the midsole layer and the sole plate are configured to allow the bladder to nest in the recess with a bonding region outward of the contoured upper and lower surfaces, secure bonding and the desirable cushioning characteristics of the contoured surfaces near the bonding region can both be achieved.

In one or more embodiments, bonding may be at a peripheral flange of the polymeric bladder. For example, the polymeric bladder may have a peripheral flange establishing at least a portion of an outer perimeter of the polymeric bladder and at least partially surrounding the fluid-filled interior cavity. The peripheral flange may be disposed between the peripheral bonding region of the midsole layer and the peripheral bonding region of the sole plate. The peripheral bonding region of the midsole layer may be bonded to an upper side of the peripheral flange and the peripheral bonding region of the sole plate may be bonded to a lower side of the peripheral flange. Alternatively, in one or more other embodiments, the peripheral bonding region of the midsole layer may be bonded to the peripheral bonding region of the sole plate. For example, the entire polymeric bladder may be inward of the peripheral bonding regions, with the midsole layer and the sole plate contacting one another at the bonding regions outward of the polymeric bladder.

In one or more embodiments, the midsole layer and the sole plate may be configured to interfit with the polymeric bladder's upper and lower surfaces, respectively. The contoured upper surface of the polymeric bladder may be mated with the lower surface of the midsole layer in the first recess. Similarly, the contoured lower surface of the polymeric bladder may be mated with the upper surface of the sole plate in the second recess. Accordingly, in such embodiments and within the dimensional tolerances of the manufacturing processes utilized in forming the components of the sole structure, the surface profile of the contoured upper surface of the polymeric bladder is configured to be the same as the surface profile of the lower surface of the midsole layer in the first recess so that the surfaces are coincident. Similarly, the surface profile of the contoured lower surface of the polymeric bladder may be configured to be the same as the surface profile of the upper surface of the sole plate in the second recess so that the surfaces are coincident.

In one or more embodiments, the contoured upper surface of the polymeric bladder may include a plurality of rounded protrusions, and the lower surface of the midsole layer may include a plurality of rounded concavities corresponding with the plurality of rounded protrusions. In the same embodiment or in one or more different embodiments, the contoured lower surface of the polymeric bladder may include a plurality of domed portions, and the upper surface of the sole plate may include a plurality of rounded concavities corresponding with the plurality of domed portions.

The polymeric bladder may include an upper polymeric sheet and a lower polymeric sheet bonded to one another and enclosing the fluid-filled interior cavity. A tensile component may be disposed in the fluid-filled interior cavity. For example, the tensile component may include a first tensile layer secured to the upper polymeric sheet, a second tensile layer, and a plurality of tethers connecting the first tensile layer to the second tensile layer. The lower polymeric sheet may be joined to the second tensile layer at a plurality of lower bonds, and the lower polymeric sheet may be displaced from the second tensile layer between at least some of the lower bonds by fluid in the fluid-filled interior cavity. For example, if the lower bonds are arranged to form closed shapes, the portions of the lower polymeric sheet surrounded by the closed shapes are unbonded (i.e., not bonded to the second tensile layer), and may therefore be displaced from the second tensile layer by the fluid, forming domed surfaces. In such an embodiment, the majority of the contours at the upper surface of the polymeric bladder may extend along the medial side and the lateral side. The majority of the lower surface of the polymeric bladder may be contoured due to the domed portions. For example, the lower surface of the polymeric bladder may have domed surfaces over its entirety.

In one or more embodiments, a plurality of upper bonds joins the upper polymeric sheet to the first tensile layer. The upper polymeric sheet may be displaced from the first tensile layer between the upper bonds along a medial side of the polymeric bladder by fluid in the fluid-filled interior cavity, forming a plurality of rounded protrusions extending along the medial side. The upper polymeric sheet may also be displaced from the first tensile layer between the upper bonds along a lateral side of the polymeric bladder by fluid in the fluid-filled interior cavity, forming a plurality of rounded protrusions extending along the lateral side. The upper polymeric sheet may be secured to the first tensile layer between the rounded protrusions along the lateral side and the rounded protrusions along the medial side, and therefore does not form protrusions or domed surfaces in the area where it is secured to the first tensile layer. Between the rounded protrusions along the lateral and medial sides, the polymeric bladder may be relatively flat.

The midsole layer may be configured in a complementary manner (i.e., with a complementary geometry) to interfit with the particular contoured shape of the upper polymeric sheet, and the sole plate may be configured to interfit with the particular contoured shape of the lower polymeric sheet. For example, the lower surface of the midsole layer may include a plurality of rounded concavities corresponding with the plurality of rounded protrusions of the upper polymeric sheet along the medial side and along the lateral side of the polymeric bladder so that the lower surface of the midsole layer fits flush against the contoured upper surface of the polymeric bladder. The contoured lower surface of the polymeric bladder may include a plurality of domed portions where the lower polymeric sheet is displaced from the second tensile layer by fluid in the fluid-filled interior cavity, and the upper surface of the sole plate may include a plurality of rounded concavities corresponding with the plurality of domed portions so that the upper surface of the sole plate fits flush against the contoured lower surface of the polymeric bladder.

In one or more embodiments, the midsole layer may define a through-hole extending through the midsole layer over the polymeric bladder. This may allow the polymeric bladder to be viewed through the through-hole. The cushioning received by the portion of the wearer's foot resting on the sole structure at the through-hole will be primarily provided by the polymeric bladder. Cushioning received by the portion of the wearer's foot resting on the sole structure away from the through hole may be provided by a combination of the midsole and the polymeric bladder underlying the midsole, as those two components are vertically stacked under that portion of the wearer's foot.

The sole plate may provide a variety of characteristics and features. For example, the sole plate may be stiffer than the midsole layer and the bladder, both in compressive stiffness and in bending stiffness. The sole plate may have integral cleat mounting features that may extend at the outer surface of the sole plate, away from the bladder. For example, the cleat mounting features may be downwardly-extending protrusions with central apertures that are each configured to receive and retain a cleat.

Additionally, the sole plate may have a forefoot region, a midfoot region, and a heel region, and the sole structure may include a forked reinforcement plate secured to or integrally formed as a portion of the sole plate. The forked reinforcement plate may have a central portion. The central portion may be at the midfoot region of the sole plate. The forked reinforcement plate may have a forward medial arm and a forward lateral arm both extending forward from the central portion. The forked reinforcement plate may have a rearward medial arm and a rearward lateral arm both extending rearward from the central portion. The forward medial arm and the rearward medial arm may border a medial side of the sole plate, and the forward lateral arm and the rearward lateral arm may border a lateral side of the sole plate. The forked reinforcement plate increases the thickness of the sole structure and the bending stiffness of the sole structure in the areas where the forked reinforcement plate extends. By extending along the lateral side and the medial side, increased support is provided to react forces in these areas, such as due to lateral (i.e., sideways) movements.

Additionally, the arms of the forked reinforcement plate generally correspond with and underlie the portions of the polymeric bladder having domed portions at the medial and lateral sides of the lower surface of the bladder. The additional cushioning of the domed portions and the added support of the forked reinforcement plate provide comfort and support during lateral movements.

The arms of the forked reinforcement plate may also extend along those portions of the sole plate having the cleat mounting features. Accordingly, the sole plate is reinforced at the areas that may undergo relatively high stresses due to the forces on the cleats transferred to the sole plate.

A method of manufacturing a sole structure for an article of footwear comprises stacking a sole plate, a polymeric bladder, and a midsole layer so that the polymeric bladder is nested in a cavity that is formed by a first recess in a lower surface of the midsole layer and by a second recess in an upper surface of the sole plate. As stacked, a contoured upper surface of the polymeric bladder is inward of a peripheral bonding region of the midsole layer and a contoured lower surface of the polymeric bladder is inward of a peripheral bonding region of the sole plate. The polymeric bladder defines a sealed, fluid-filled interior cavity. The method further comprises securing the midsole layer relative to the sole plate at the peripheral bonding region of the midsole layer.

In one or more embodiments, the midsole layer is secured directly to the sole plate. More specifically, securing the midsole layer relative to the sole plate may include bonding the peripheral bonding region of the midsole layer to the peripheral bonding region of the sole plate. In such embodiments, the polymeric bladder is entirely inward of the peripheral bonding regions.

In other embodiments, the midsole layer is secured to a peripheral flange of the polymeric bladder. More specifically, in such embodiments, the polymeric bladder includes a peripheral flange establishing at least a portion of an outer perimeter of the polymeric bladder and at least partially surrounding the fluid-filled interior cavity. Securing the midsole layer relative to the sole plate includes bonding the peripheral bonding region of the midsole layer to an upper side of the peripheral flange and bonding the peripheral bonding region of the sole plate to a lower side of the peripheral flange.

The method may further comprise inflating the fluid-filled interior cavity of the polymeric bladder prior to stacking the sole plate, the polymeric bladder, and the midsole layer. Accordingly, the lower surface of the midsole layer and the upper surface of the sole plate are configured to conform to the inflated polymeric bladder with its contoured surfaces.

The method may further comprise securing a forked reinforcement plate to the sole plate. The forked reinforcement plate may be secured to the upper surface of the sole plate, in which case it is between the sole plate and the polymeric bladder. In other embodiments, the forked reinforcement plate may be secured to the lower surface of the sole plate. Alternatively, the forked reinforcement plate may be integrally formed with the sole plate.

The midsole layer, the polymeric bladder, and the sole plate may be provided in an already formed state, ready to be stacked. In other embodiments, the method may include forming one or more of the midsole layer, the polymeric bladder, or the sole plate.

For example, the method may comprise, prior to stacking the sole plate, the polymeric bladder, and the midsole layer, forming the lower surface of the midsole layer with the first recess and with a plurality of concavities at which the midsole layer is configured to mate with a plurality of rounded protrusions of the contoured upper surface of the polymeric bladder.

The method may comprise, prior to stacking the sole plate, the polymeric bladder, and the midsole layer, forming the upper surface of the sole plate with the second recess and with a plurality of concavities at which the sole plate is configured to mate with a plurality of domed portions of the contoured lower surface of the polymeric bladder.

The method may comprise, prior to stacking the sole plate, the polymeric bladder, and the midsole layer, forming the polymeric bladder by disposing a tensile component between an upper polymeric sheet and a lower polymeric sheet, the tensile component including a first tensile layer, a second tensile layer, and a plurality of tethers connecting the first tensile layer to the second tensile layer. Forming the polymeric bladder may further comprise bonding the lower polymeric sheet to the upper polymeric sheet around the tensile component, and to the second tensile layer at a plurality of bonds. The lower polymeric sheet may be unbonded to and displaced from the second tensile layer adjacent to at least some of the bonds by fluid in the fluid-filled interior cavity when the fluid-filled interior cavity is inflated.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 shows a sole structure 10 for an article of footwear 11. The sole structure 10 includes a midsole layer 12, a polymeric bladder 14 (also referred to as the bladder 14), shown for example in FIG. 7, and a sole plate 16 that interfit with one another and stack together to capture the polymeric bladder 14 between the midsole layer 12 and the sole plate 16 as best shown in FIGS. 9-12 and as discussed herein. The sole structure 10 may also include a forked reinforcement plate 19 that is secured to the sole plate 16 or is integrally formed as a portion of the sole plate 16. The midsole layer 12 has an upper surface 18 that serves as a foot-receiving surface on which a foot is supported when the sole structure 10 is secured to a lower extent of a footwear upper 23 (indicated in phantom in FIG. 1) with the sole structure 10 is disposed between the foot and the ground.

The sole structure 10 has a forefoot region 22, a midfoot region 24, and a heel region 26. The forefoot region 22 may be generally associated with the toes and joints connecting the metatarsals with the phalanges. The midfoot region 24 may be generally associated with the arch of a foot. The heel region 26 may be generally associated with the heel of a foot, including the calcaneus bone. The sole structure 10 has a lateral side 28 and a medial side 30. In particular, the lateral side 28 and the medial side 30 may be opposing sides of the sole structure 10, and may extend along the forefoot region 22, the midfoot region 24, and the heel region 26. As shown, the sole structure 10 is for an athletic shoe, such as for but not limited to use for athletic activities such as baseball. In other embodiments, the article of footwear 11 could be a dress shoe, a work shoe, a sandal, a slipper, a boot, or any other category of footwear.

Figure 2:
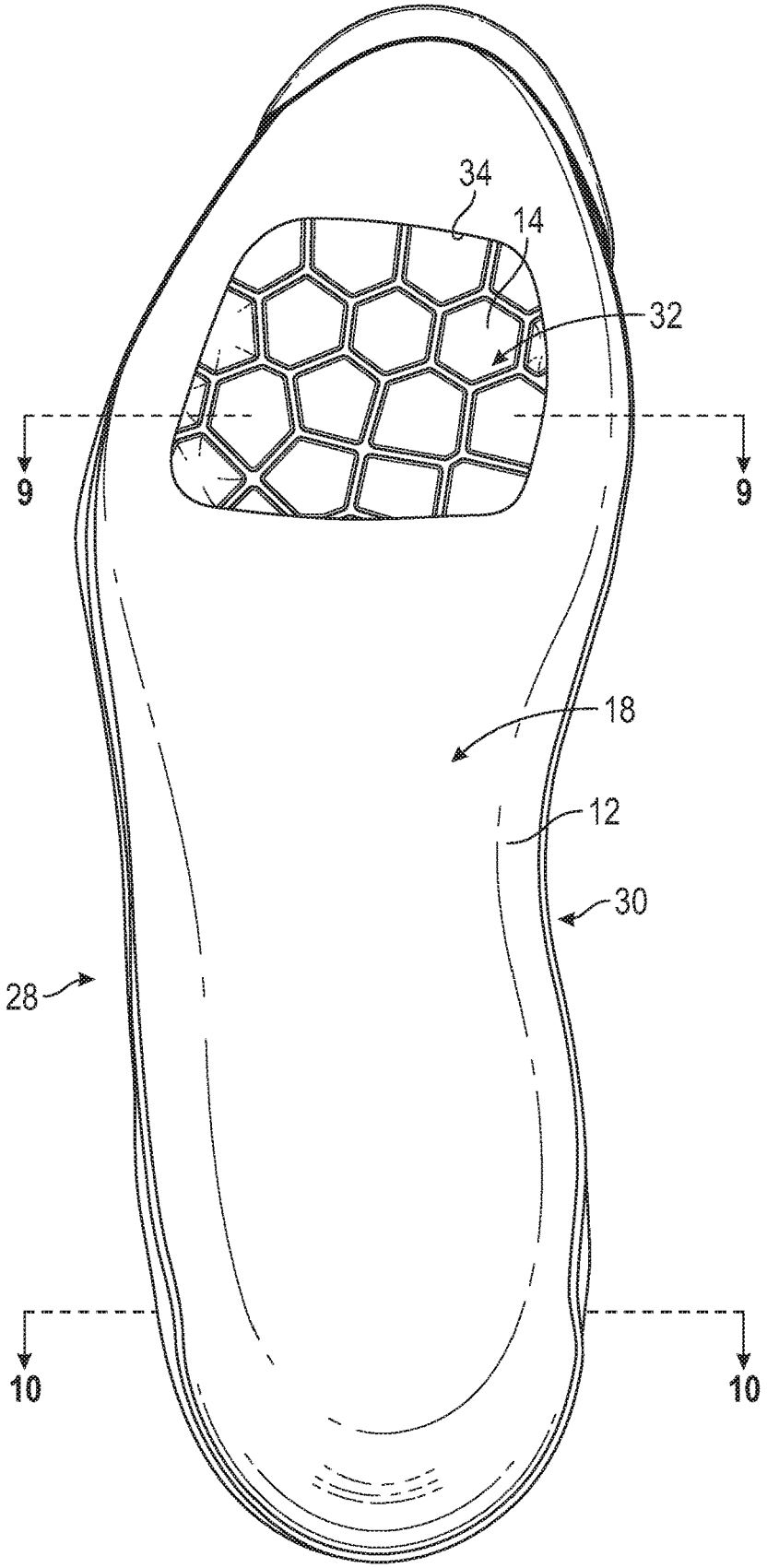
FIG. 2 is a schematic illustration in top view of the sole structure of FIG. 1.

The midsole layer 12 may be a resilient foam layer that provides cushioning and is resiliently deformable to provide energy return. By way of non-limiting example, the midsole layer 12 may include any of a polyurethane foam, a polyurethane ethylene-vinyl acetate (EVA) foam, and heat-expanded and molded EVA foam pellets. Only a portion of an upper surface 32 of the polymeric bladder 14 is visible in FIG. 2, through a through-hole 34 that extends through the midsole layer 12 in the forefoot region 22 of the midsole layer 12.

Figure 6:
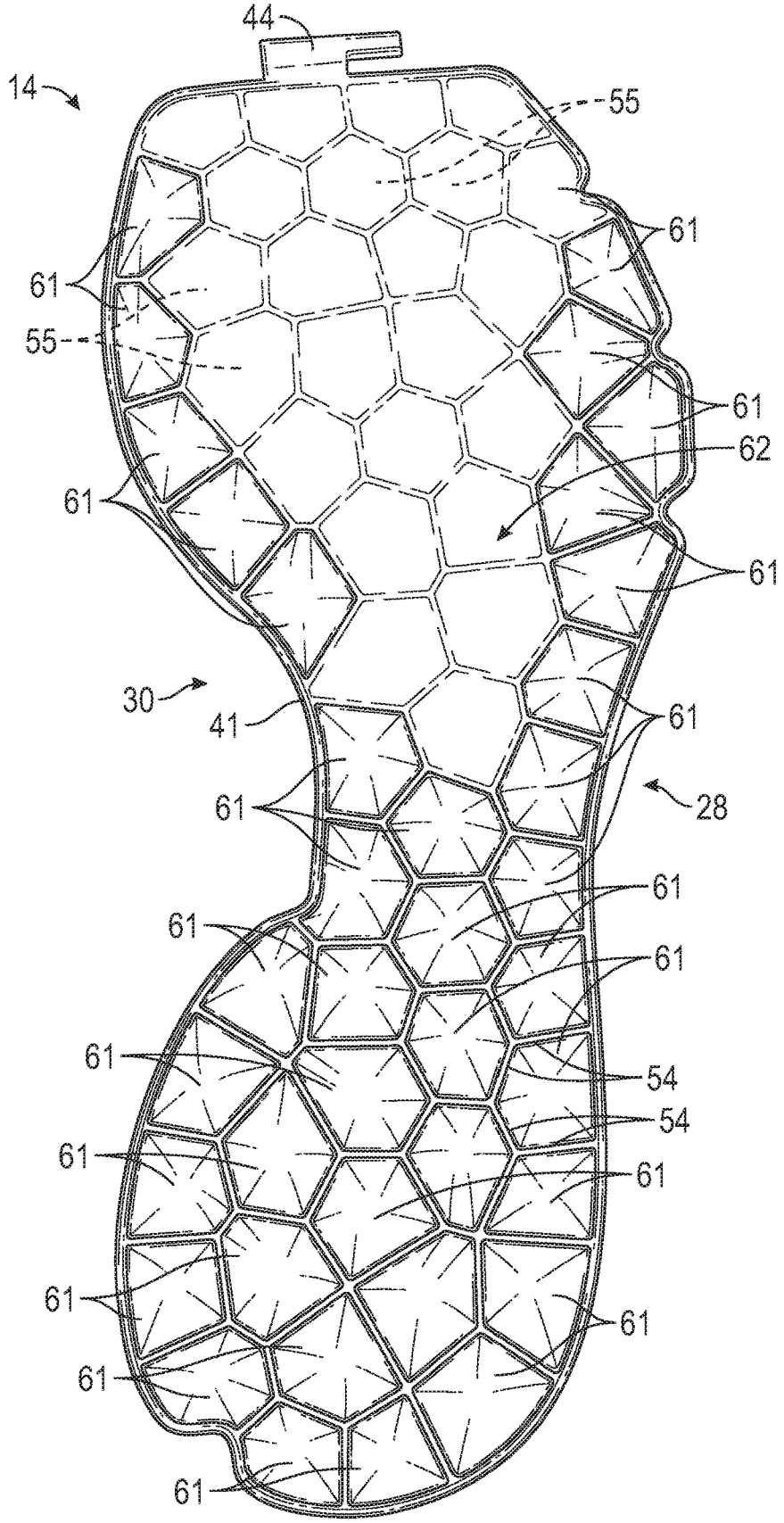
FIG. 6 is a schematic illustration in bottom view of the polymeric bladder of FIG. 5.
Figure 7:
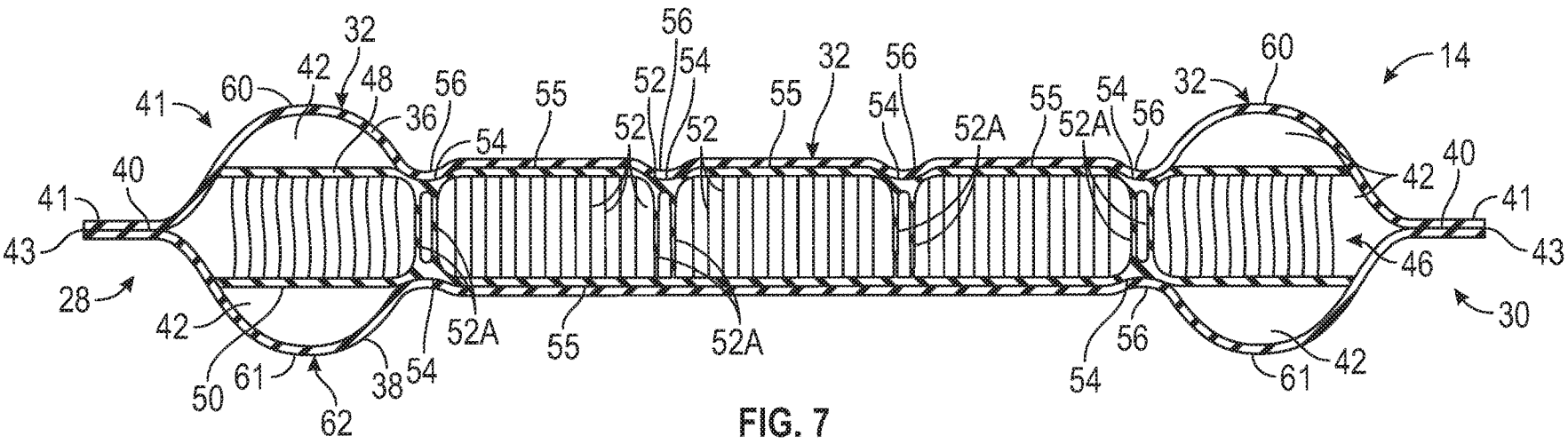
FIG. 7 is a schematic illustration in cross-sectional view of the polymeric bladder of FIG. 5 taken at lines 7-7 in FIG. 5.
Figure 8:
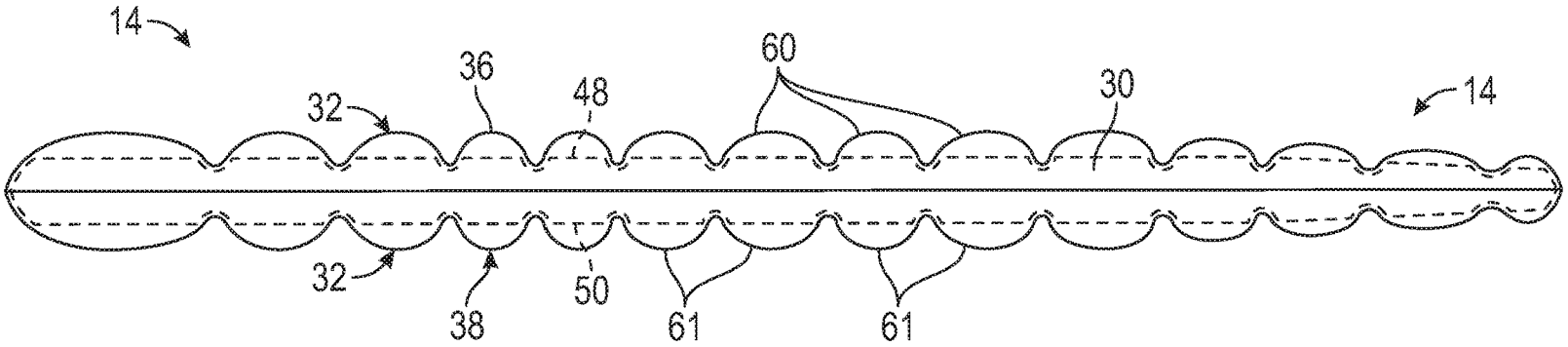
FIG. 8 is a schematic illustration in medial side view of the polymeric bladder of FIG. 5.

Referring to FIG. 7, the polymeric bladder 14 includes an upper polymeric sheet 36 and a lower polymeric sheet 38 bonded to one another at a peripheral bond 40 along a peripheral flange 41 to enclose an interior cavity 42. The peripheral flange 41 establishes an outer perimeter 43 of the polymeric bladder 14 and peripherally surrounds the fluid-filled interior cavity 42. When the sheets 36, 38 are bonded together at the peripheral bond 40 and sealed together, such as by sealing an inflation port 44 shown in FIGS. 5 and 6, the upper polymeric sheet 36 and the lower polymeric sheet 38 retain a fluid in the interior cavity 42. As used herein, a "fluid" filling the interior cavity 42 may be a gas, such as air, nitrogen, another gas, or a combination thereof.

The upper and lower polymeric sheets 36, 38 can be a variety of polymeric materials that can resiliently retain a fluid such as nitrogen, air, or another gas. Examples of polymeric materials for the upper and lower polymeric sheets 36, 38 include thermoplastic urethane, polyurethane, polyester, polyester polyurethane, and polyether polyurethane. Moreover, the upper and lower polymeric sheets 36, 38 can each be formed of layers of different materials including polymeric materials. In one embodiment, each of the upper and lower polymeric sheets 36, 38 is formed from thin films having one or more thermoplastic polyurethane layers with one or more barrier layers of a copolymer of ethylene and vinyl alcohol (EVOH) that is impermeable to the pressurized fluid contained therein such as a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. Additional suitable materials for the upper and lower polymeric sheets 36, 38 are disclosed in U.S. Pat. Nos. 4,183,156 and 4,219,945 to Rudy which are incorporated by reference in their entireties. Further suitable materials for the upper and lower polymeric sheets 36, 38 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the bladder 14, engineering properties such as tensile strength, stretch properties, fatigue characteristics, dynamic modulus, and loss tangent can be considered. For example, the thicknesses of the upper and lower polymeric sheets 36, 38 used to form the bladder 14 can be selected to provide these characteristics.

As best shown in FIG. 7, the bladder 14 includes a tensile component 46 disposed in the interior cavity 42. The tensile component 46 includes a first tensile layer 48, a second tensile layer 50, and a plurality of tethers 52 spanning the interior cavity 42 from the first tensile layer 48 to the second tensile layer 50. The tethers 52 connect the first tensile layer 48 to the second tensile layer 50. Only some of the tethers 52 are indicated with reference numbers in FIG. 7. The tethers 52 may also be referred to as fabric tensile members or threads and may be in the form of drop threads that connect the first tensile layer 48 and the second tensile layer 50. The tensile component 46 may be formed as a unitary, one-piece textile element having a spacer-knit textile. It should be appreciated that the first tensile layer 48 and the second tensile layer 50 are permeable by the gas in the interior cavity 42. As such, the interior cavity 42 extends through the first tensile layer 48 and the second tensile layer 50, in between and around the tethers 52, from the inner surface of the upper polymeric sheet 36 to the inner surface of the lower polymeric sheet 38.

Figure 5:
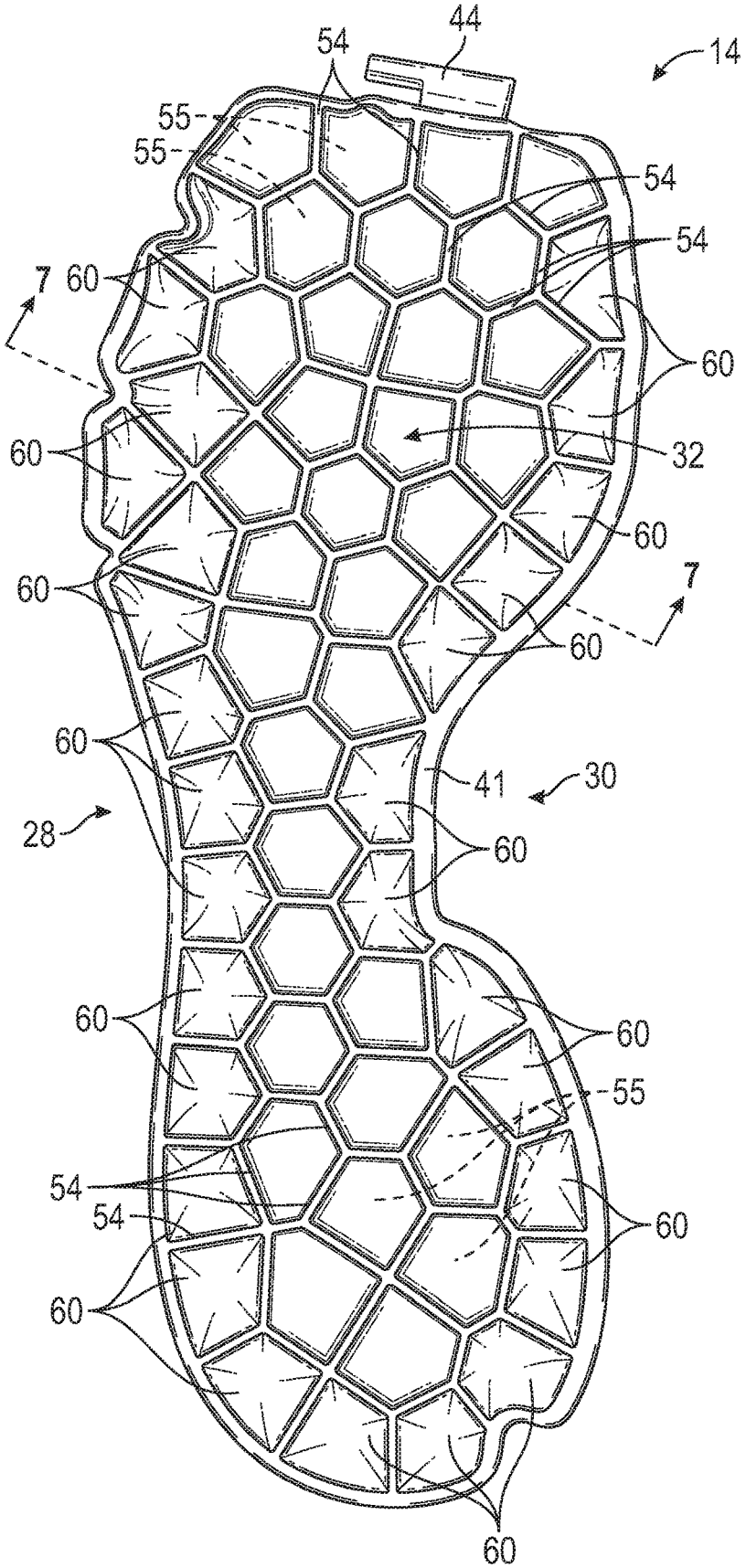
FIG. 5 is a schematic illustration in top view of a polymeric bladder included in the sole structure of FIG. 1.

Referring to FIGS. 5 and 7, the upper polymeric sheet 36 is bonded to the upper surface of the first tensile layer 48 at a plurality of bonds 54 that may be formed by protrusions of a mold tool used during radio frequency welding, thermoforming, or other forming process, that force the upper polymeric sheet 36 against the first tensile layer 48. The bonds 54 protrude inward into the interior cavity 42 and slightly deform the upper polymeric sheet 36, creating grooves 56. Tethers 52 that are aligned with (i.e., directly under) the inwardly-protruding bonds 54 are deformed by heat, by compression of the overlaying of material of the first tensile layer 48, and/or by the overlaying material of the first tensile layer 48 coating the tethers 52 such that the tethers 52 are shorter, thicker, or both shorter and thicker at the inwardly-protruding bonds 54 than elsewhere. Such tethers are indicated with reference numeral 52A in FIG. 7 and may be referred to as modified tethers. However, references to tethers 52 herein include tethers 52 and tethers 52A unless otherwise specified.

When the interior cavity 42 is inflated, the modified tethers 52A result in the depressed grooves 56 in the upper surface 32 of the bladder 14. The bonds 54 and grooves 56 are arranged to define closed shapes that may be polygonal, as best shown in FIG. 5 or alternatively could be circular, oval, etc. The grooves 56 encourage articulation of the bladder 14, as the overall thickness of the bladder 14 is reduced at the grooves 56, decreasing bending stiffness. The pattern of bonds 54 and resulting grooves 56 may be arranged so that the grooves 56 present flexion axes where flexion is desired, such as under the metatarsal phalangeal joints.

In FIG. 5, only some of the bonds 54 are labelled for clarity in the drawings. Anti-weld material is applied to selected areas of the outer surface of the first tensile layer 48 and/or to the inner surface of the upper polymeric sheet 36 where bonding of the first tensile layer 48 to the upper polymeric sheet 36 is not desired. To provide rounded protrusions 60 in the locations shown in FIG. 5, the anti-weld material is applied only along the perimeter of the first tensile layer 48 and/or the upper polymeric sheet 36 where it overlays the perimeter along the medial side, the lateral side, and around the rear of the heel region 26 at portions between the bonds 54 of the outermost closed shapes. The upper polymeric sheet 36 is not bonded to the first tensile layer at those portions, and is displaced from the first tensile layer 48 adjacent to the bonds 54 along the medial side 28 of the polymeric bladder 14 by fluid in the fluid-filled interior cavity 42, forming a plurality of rounded protrusions 60 along the medial side 30 where the upper polymeric sheet 36 is displaced from the first tensile layer 48, and along the lateral side 28 of the polymeric bladder 14 and around the rear of the heel region 26.

As shown in FIG. 5, portions of the upper polymeric sheet 36 between the forwardmost row of closed shapes formed by the bonds 54 are bonded to the first tensile layer 48 at surface bonds 55, as are portions between closed shapes formed by the bonds 54 and that fall between the rounded protrusions 60 along the lateral side 30 and the rounded protrusions 60 along the medial side 28 (i.e., transversely across the upper surface 32 in FIG. 5). Only some of the surface bonds 55 are labeled in FIG. 5, but portions at all of the closed shapes not labelled as rounded protrusions 60 have surface bonds 55. Accordingly, the upper polymeric sheet 36 is not displaced from the first tensile layer 48 in these areas, and so does not form protrusions or domed surfaces in these areas. Stated differently, the upper polymeric sheet 36 has a contoured upper surface 32, with the rounded protrusions 60 along the lateral and medial sides 28, 30 and around the rear of the heel region 26. Due to the absence of anti-weld material, the upper polymeric sheet 36 has a relatively flat expanse between the rounded protrusions 60 across the upper surface 32.

Referring to FIGS. 6 and 7, anti-weld material is also applied to the outer surface of the second tensile layer 50 and/or the inner surface of the lower polymeric sheet 38 at selected areas where bonding is not desired. The anti-weld material is applied at portions between the bonds 54 not only in the same regions as on the upper polymeric sheet 36 (i.e., at the outermost closed shapes at the perimeter along the medial side 30, the lateral side 28, and around the rear of the heel region 26), but also at the portions between the bonds 54 at the more inwardly-disposed closed shapes in the heel region 26 and at a rearward extent of the midfoot region 24). When the bladder 14 is inflated, this results in domed portions 61 similar to the rounded protrusions 60. As used herein, "domed" means rounded, and need not be hemispherical.

Portions of the lower polymeric sheet 38 between the forwardmost row of closed shapes formed by the bonds 54 are bonded to the second tensile layer 50 at surface bonds 55, as are portions between closed shapes formed by the bonds 54 falling between the domed portions 61 along the lateral side 28 and domed portions 61 along the medial side 30 (i.e., transversely across the lower surface 62 of the bladder 14 in FIG. 6) in the forefoot region 22 and the forward extent of the midfoot region 24. Only some of the surface bonds 55 are labeled in FIG. 6, but surface bonds 55 are at all of the closed shapes not labelled as domed portions 61. Accordingly, the lower polymeric sheet 38 is not displaced from the second tensile layer 50 in these areas having surface bonds 55, and so does not form protrusions or domed surfaces in these areas. Stated differently, the lower polymeric sheet 40 has a contoured lower surface 62, with the domed portions 61 everywhere except at a relatively flat expanse in the forefoot region 22 and at a forward extent of the midfoot region 24 between the domed portions 61 at the lateral and medial sides 28, 30. In the portion of the lower polymeric sheet 38 at which there are surface bonds 55, slight recesses may be formed across from the inwardly-protruding bonds 54 at the upper polymeric sheet 36 by the tension caused by the shortened and thickened tethers 52A. Locating the rounded protrusions 60 and the domed portions 61 along the lateral and medial sides 28, 30 provides cushioning that reacts against forces that are at least partially transverse (i.e., sideways toward the medial side 30 or toward the lateral side 28) as may be caused by lateral cutting movements of the wearer's foot.

The midsole layer 12 and bladder 14, including the rounded protrusions 60 and the domed portions 61, provide staged cushioning under compressive forces experienced during dynamic loading of the sole structure 10. For example, if the midsole layer 12 has a lower compressive stiffness than the inflated bladder 14, then a first stage of cushioning may occur as the midsole layer 12 begins to compress, and a second stage of cushioning occurs as the stiffer bladder 14 subsequently begins to compress, with the rounded protrusions 60 and/or the domed portions 61 at least partially flattening under the dynamic load. The sole plate 16 and forked reinforcement plate 19 may be stiffer than both the midsole layer 12 and the bladder 14. For example, the sole plate 16 and forked reinforcement plate 19 may be a carbon fiber, a carbon fiber composite, such as a carbon fiber-filled nylon, a fiberglass-reinforced nylon, which may be an injected, fiber-reinforced nylon, a fiber strand-lain composite, a thermoplastic elastomer, steel, or another material or combinations of these, but is not limited to these materials. When the bladder 14 is compressed, it reacts against the conforming surfaces of the sole plate 16. Both the midsole layer 12 and the polymeric bladder 14 are elastically resilient and return to their uncompressed shapes as the dynamic compressive load is removed, returning at least some of the deformation energy.

The contoured upper surface 32 and the contoured lower surface 62 of the polymeric bladder 14 present challenges to securely bonding to adjacent components of the sole structure 10, especially at the lateral and medial sides 28, 30. This may be due to bonding processes that generally involve pressure applied relative to the bladder 14 in a vertical direction (i.e., normal to the top and bottom views of FIGS. 5 and 6), which may be less effective in bonding surfaces with large contours having normal vectors that are at significantly large angles to the vertical direction.

In order to address this problem, the polymeric bladder 14, the midsole layer 12 and the sole plate 16 are configured to stack together to capture the bladder 14 between the midsole layer 12 and the sole plate 16 such that bonding occurs outward of the contoured surfaces. More specifically, as best shown in FIGS. 4 and 9-12, the midsole layer 12 has a lower surface 70 with a first recess 72. The first recess 72 has an outer periphery 74 that is spaced inward of an outer periphery 76 of the midsole layer 12. A peripheral bonding region 78 of the lower surface 70 is disposed between the outer periphery 76 of the midsole layer 12 and the outer periphery 74 of the first recess 72. Similarly, the sole plate 16 has an upper surface 80 with a second recess 82 aligned with the first recess 72 of the midsole layer 12 to form a cavity 84 between the sole plate 16 and the midsole layer 12. The upper surface 80 of the sole plate 16 has a peripheral bonding region 86 between an outer periphery 88 of the sole plate 16 and an outer periphery 90 of the second recess 82.

The polymeric bladder 14 is nested in the cavity 84 between the midsole layer 12 and the sole plate 16 with the contoured upper surface 32 of the polymeric bladder 14 inward of the peripheral bonding region 78 of the midsole layer 12, and with the contoured lower surface 62 of the polymeric bladder inward of the peripheral bonding region 86 of the sole plate 16. The midsole layer 12 and the sole plate 16 are configured to interfit with the polymeric bladder 14 at both its upper and lower surfaces 32, 62. As shown in FIGS. 9-12, the contoured upper surface 32 of the polymeric bladder 14 is mated with the lower surface 70 of the midsole layer 12 in the first recess 72. As shown in FIGS. 4 and 9-12, the lower surface 70 of the midsole layer 12 includes a plurality of rounded concavities 92 corresponding with the plurality of rounded protrusions 60 of the contoured upper surface 32 of the polymeric bladder 14 along the medial side 30 and along the lateral side 28 of the polymeric bladder 14 so that the lower surface 70 of the midsole layer 12 fits flush against the contoured upper surface 32 of the polymeric bladder 14. Only some of the rounded concavities 92 and rounded protrusions 60 are labelled in FIG. 4

Similarly, the contoured lower surface 62 of the polymeric bladder 14 is mated with the upper surface 80 of the sole plate 16 in the second recess 82. The upper surface 80 of the sole plate 16 includes a plurality of rounded concavities 94 corresponding with the plurality of domed portions 61 of the bottom surface 62 of the polymeric bladder 14 so that the upper surface 80 of the sole plate 16 fits flush against the contoured lower surface 62 of the polymeric bladder 14. The sole plate 16 may be a transparent material so that the polymeric bladder 14 is visible through the sole plate at the bottom and sides of the sole structure, such as in FIG. 3 at least at those portions not covered by the forked reinforcement plate 19. If the forked reinforcement plate 19 is not transparent, or at all portions if the forked reinforcement plate 19 is transparent.

The midsole layer 12 is thus configured in a geometrically complementary manner to interfit with the particular contoured shape of the upper polymeric sheet 36, and the sole plate 16 is configured to interfit with the particular contoured shape of the lower polymeric sheet 38 of the inflated polymeric bladder 14.

Accordingly, within the dimensional tolerances of the manufacturing processes utilized in forming the components of the sole structure 10, the surface profile of the contoured upper surface 32 of the polymeric bladder 14 is configured to be the same as the surface profile of the lower surface 70 of the midsole layer 12 in the first recess 72 so that the surfaces 32, 70 are coincident. The surface profile of the contoured lower surface 62 of the polymeric bladder 14 is configured to be the same as the surface profile of the upper surface 80 of the sole plate 16 in the second recess 82 so that the surfaces 62, 80 may be coincident at least in embodiments in which any forked reinforcement plate 19 is at the lower surface 102 of the sole plate 16. As is apparent in FIG. 4, the bladder 14 is shorter in length than the midsole layer 12 and sole plate 16. Forward of the forward edge 81 of the bladder 14, the bonding region 78 of the midsole layer 12 contacts and bonds directly to the bonding region 86 of the sole plate 16. The bonds 54 and the closed shapes of the upper surface 32 of the bladder 14 that have surface bonds 55 to the first tensile layer 48 and do not form rounded protrusions 60 are not shown in FIG. 4 for clarity in the drawings.

Because the midsole layer 12 and the sole plate 16 are configured to allow the bladder 14 to nest in the cavity 84 that is specifically configured to accommodate the bladder's 14 contoured upper and lower surfaces 32, 62, with the bonding regions 78, 86 outward of the contoured upper and lower surfaces 32, 62 (i.e., outward of the rounded protrusions 60 and the domed portions 61), both secure bonding and desirable cushioning characteristics of the contoured surfaces 32, 62 near the bonding regions 78, 86 can be achieved.

Figure 9:
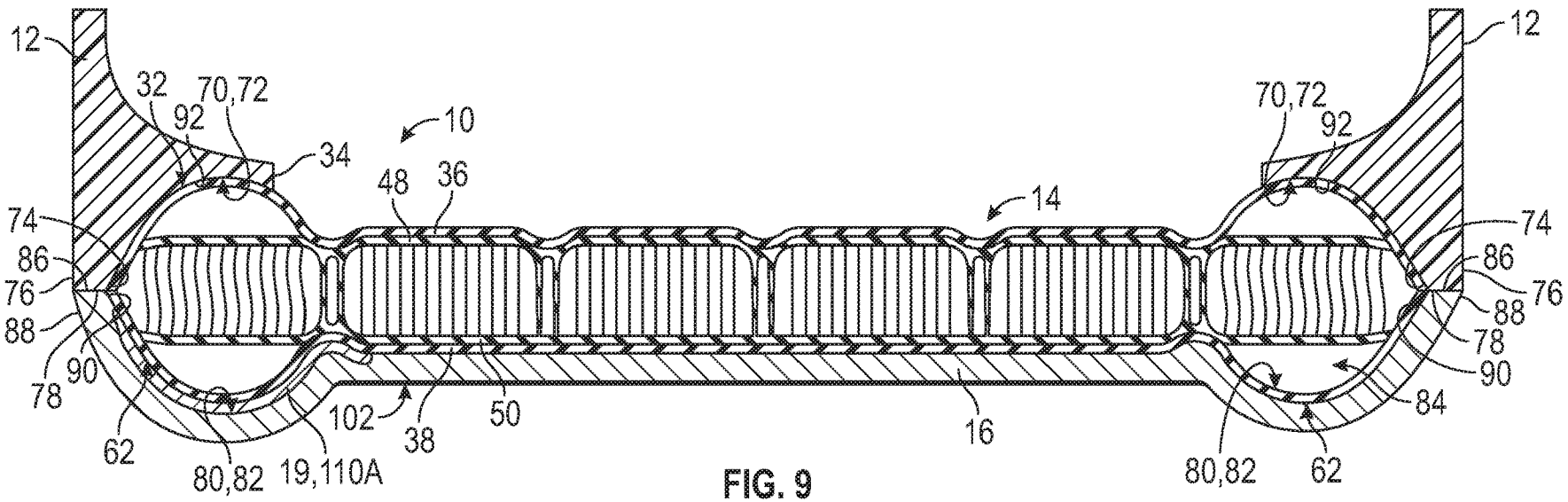
FIG. 9 is a schematic illustration in cross-sectional view of the forefoot region of the sole structure of FIG. 2 taken at lines 9-9 in FIG. 2.
Figure 10:
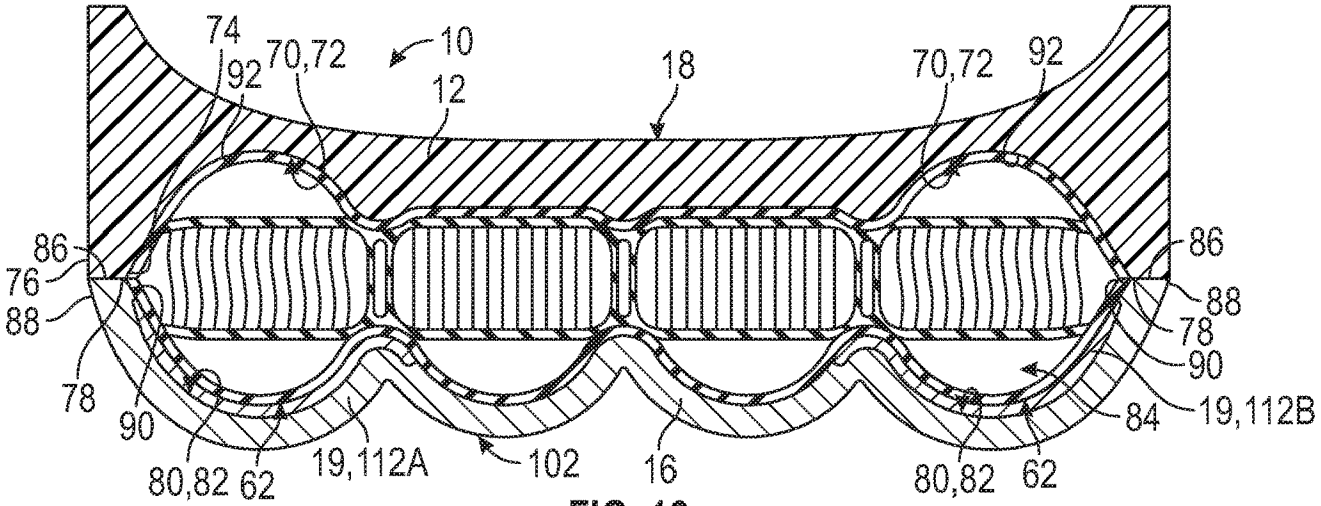
FIG. 10 is a schematic illustration in cross-sectional view of the heel region of the sole structure of FIG. 2 taken at lines 10-10 in FIG. 2.

In the embodiment of FIGS. 9 and 10, the peripheral bonding region 78 of the midsole layer 12 is bonded directly to the peripheral bonding region 86 of the sole plate 16. For example, the entire polymeric bladder 14 may be inward of the peripheral bonding regions, with the peripheral flange 41 of the bladder 14 formed very narrow or trimmed to be very narrow so that the midsole layer 12 and the sole plate 16 contact one another at the bonding regions 78, 86 outward of the polymeric bladder 14. Bonding at the bonding regions 78, 86 may occur by thermal bonding of the midsole layer 12 to the sole plate 16 and/or by adhesive disposed on one or both of the bonding regions 78, 86.

Figure 11:
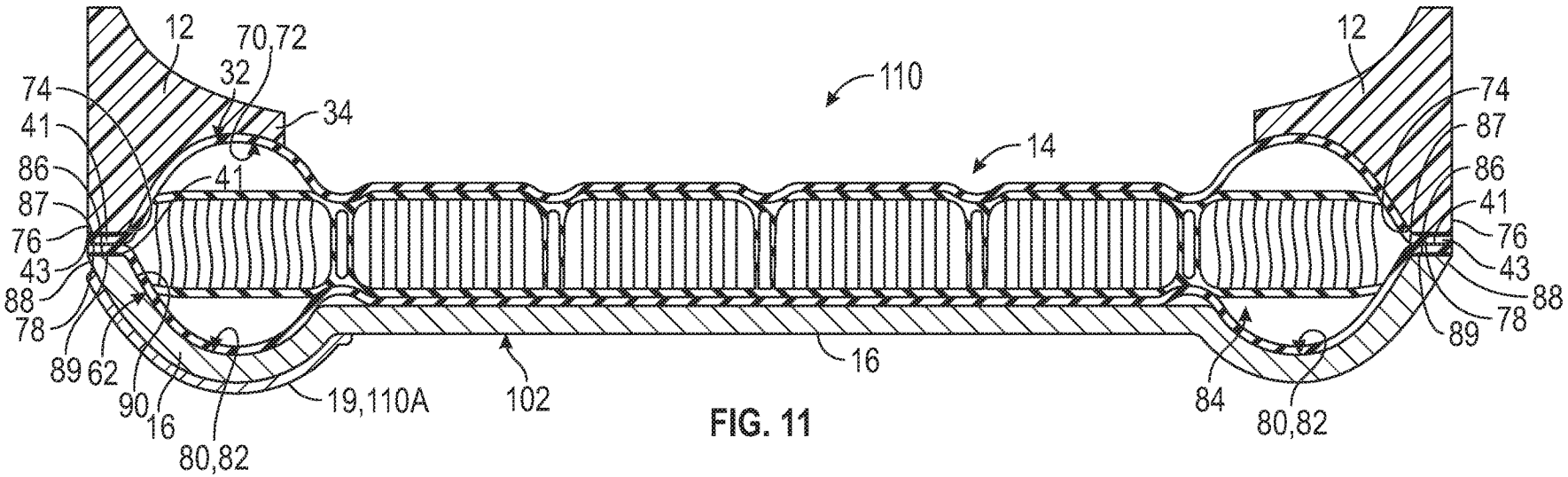
FIG. 11 is a schematic illustration in cross-sectional view of the forefoot region of an alternative sole structure.
Figure 12:
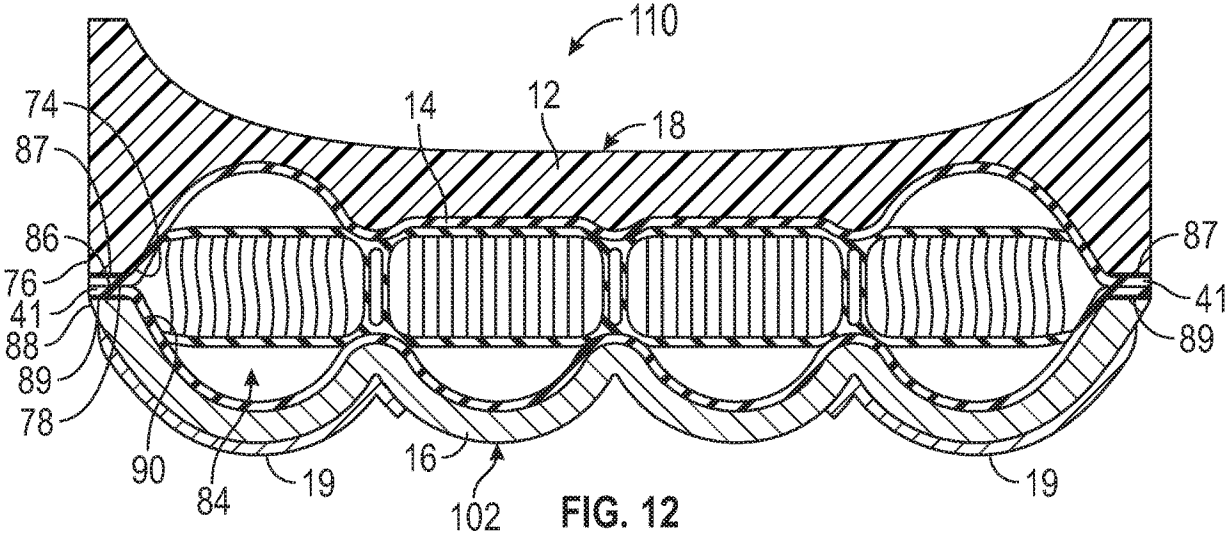
FIG. 12 is a schematic illustration in cross-sectional view of the heel region of the sole structure of FIG. 11.

In the embodiment of the sole structure 110 of FIGS. 11 and 12, the sole structure 110 is identical to the sole structure 10, with the bladder 14 resting in the cavity formed by the recesses 72, 82, except that the peripheral flange 41 of the polymeric bladder 14 is relatively wide in comparison to that of FIGS. 9 and 10. Accordingly, the peripheral flange 41 is disposed between the peripheral bonding region 78 of the midsole layer 12 and the peripheral bonding region 86 of the sole plate 16. The peripheral bonding region 86 of the midsole layer 12 is bonded to an upper side 87 of the peripheral flange 41 and the peripheral bonding region 86 of the sole plate 16 is bonded to a lower side of the peripheral flange.

Figure 3:
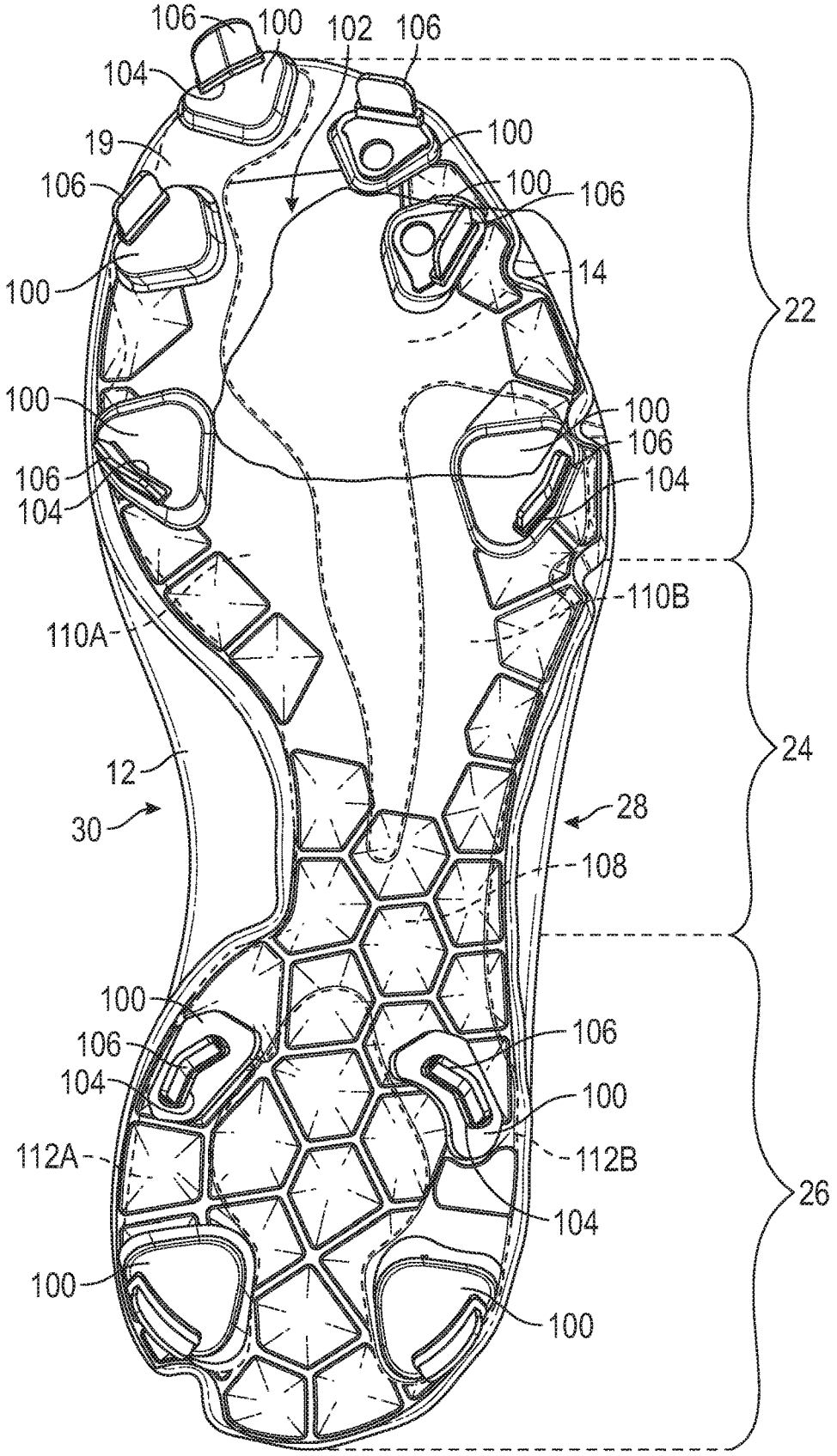
FIG. 3 is a schematic illustration in bottom view of the sole structure of FIG. 1.
Figure 4:
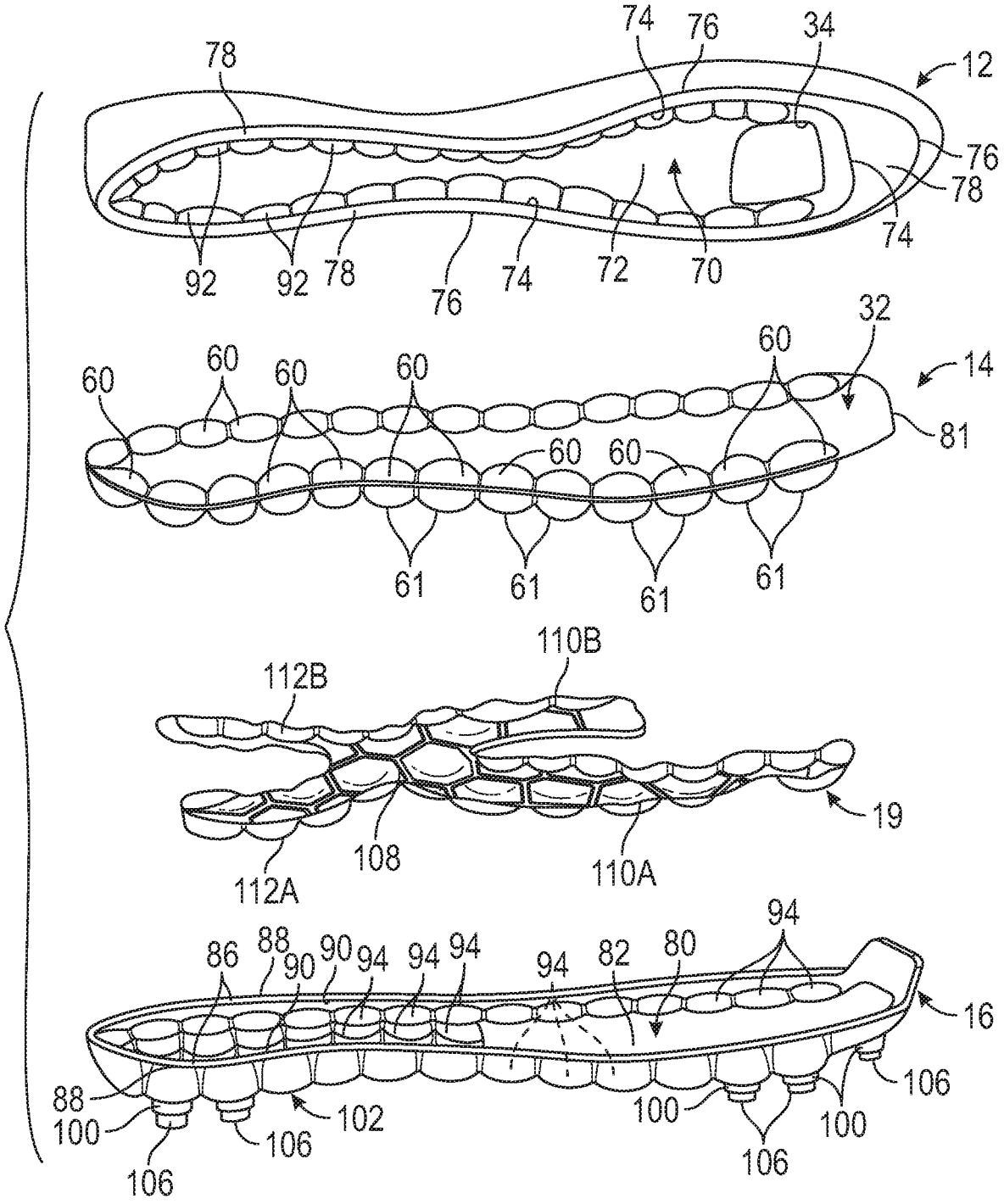
FIG. 4 is a schematic illustration in exploded perspective view of the sole structure of FIG. 1.

The sole plate 16 may provide a variety of characteristics and features. For example, the sole plate 16 may be stiffer than both the midsole layer 12 and the bladder 14, both in compressive stiffness and in bending stiffness. The sole plate 16 also has integral cleat mounting features 100 that extend at the lower surface 102 of the sole plate, away from the bladder 14, as best shown in FIGS. 1, 3 and 4. The cleat mounting features 100 are downwardly-extending protrusions with central apertures 104. The central apertures 104 are each configured to receive and retain a cleat 106.

Referring to FIGS. 3-4 and 9-10, the forked reinforcement plate 19 is secured to the upper surface 80 of the sole plate 16 between the sole plate 16 and the bladder 14. Alternatively, in the sole structure 110 shown in FIGS. 11-12, the forked reinforcement plate 19 is secured to the lower surface 102 of the sole plate 16. In either embodiment, the forked reinforcement plate 19 may be integrally formed as a portion of the sole plate 16, such as if the sole plate 16 and the forked reinforcement plate 19 are co-molded together in the same mold. The forked reinforcement plate 19 has a central portion 108 that is disposed at a rearward part of the midfoot region 24 and a forward part of the heel region 26 in FIG. 3. A forward medial arm 110A and a forward lateral arm 110B both extend forward from the central portion 108. A rearward medial arm 112A and a rearward lateral arm 112B both extend rearward from the central portion 108. The forward medial arm 110A and the rearward medial arm 112A border the medial side 30 of the sole plate 16, and the forward lateral arm 110B and the rearward lateral arm 112B border the lateral side 28 of the sole plate 16. The forked reinforcement plate 19 increases the thickness and the bending stiffness of the sole structure 10 in the areas where the forked reinforcement plate 19 extends. By extending along the lateral side 28 and the medial side 30, increased support is provided to react forces in those areas, such as due to lateral (i.e., sideways) movement.

The arms of the forked reinforcement plate 19 generally correspond with and underlie portions of the polymeric bladder 14 having domed portions 61 at the medial and lateral sides of the lower surface 62 of the bladder 14. The additional cushioning of the domed portions 61 and the added support of the forked reinforcement plate 19 provide comfort and support during lateral movements. The arms 110A, 110B, 112A, 112B of the forked reinforcement plate 19 also extend along those portions of the sole plate 16 having the cleat mounting features 100. Accordingly, the sole plate 16 is reinforced at the areas that may undergo relatively high stresses due to the forces on the cleats 106.

The sole structure 10 or 110 of FIGS. 1-12 may be manufactured according to a method 200 the steps of which are listed in Table 1 below.

TABLE 1

| STEP | ACTION |
|---|---|
| 202 | FORM MIDSOLE |
| 204 | FORM SOLE PLATE |
| 206 | FORM POLYMERIC BLADDER |
| 208 | INFLATE POLYMERIC BLADDER |
| 210 | SECURE FORKED REINFORCEMENT PLATE TO SOLE PLATE |
| 212 | STACK SOLE PLATE, POLYMERIC BLADDER AND MIDSOLE LAYER |
| 214 | SECURE MIDSOLE LAYER RELATIVE TO SOLE PLATE AT PERIPHERAL BONDING REGION |

In some embodiments, the method 200 may include forming the components of the sole structure 10 or 110 (e.g., steps 202-208). In other embodiments, the method 200 may begin with the components pre-formed, e.g., beginning at step 210. For completeness, the steps of forming the components are described. For example, the method 200 may begin with step 202, forming the midsole layer 12, including forming the lower surface 70 of the midsole layer 12 with the first recess 72 and with the plurality of rounded concavities 92 at which the midsole layer 12 is configured to mate with the plurality of rounded protrusions 60 of the contoured upper surface 32 of the polymeric bladder 14.

The method 200 may comprise step 204, forming the sole plate 16, including forming the upper surface 80 of the sole plate 16 with the second recess 82 and with the plurality of rounded concavities 94 at which the sole plate 16 is configured to mate with a plurality of domed portions 61 of the contoured lower surface 62 of the polymeric bladder 14.

The method 200 may also comprise step 206, forming the polymeric bladder 14. Step 206 may include disposing the tensile component 46 between the upper polymeric sheet 36 and the lower polymeric sheet 38, bonding the upper polymeric sheet and the lower polymeric sheet to one another around the tensile component 46 at the peripheral flange 41, and bonding the sheets 36, 38 to the tensile component 46 at the plurality of bonds 54 as described herein.

The method 200 may further comprise step 208, inflating the interior cavity 42 of the polymeric bladder 14. Accordingly, with the components formed as in steps 202-206, the lower surface 70 of the midsole layer 12 and the upper surface 80 of the sole plate 16 are configured to conform to the inflated polymeric bladder 14.

The method 200 may further comprise step 210, securing the forked reinforcement plate 19 to the sole plate 16, at the upper surface 80 in some embodiments at or at the lower surface 102 in other embodiments, as described herein. Alternatively, the forked reinforcement plate 19 may be co-molded with the sole plate 16 in step 204.

After the components are formed and the forked reinforcement plate 19 is secured to or co-molded with the sole plate 16, as in steps 202 to 210, the method 200 includes step 212, stacking the sole plate 16, the polymeric bladder 14, and the midsole layer 12 so that the polymeric bladder 14 is nested in the cavity 84 that is formed by the first recess 72 and the second recess 82. As stacked, the contoured upper surface 32 of the polymeric bladder 14 is inward of the peripheral bonding region 78 of the midsole layer 12, and the contoured lower surface 62 of the polymeric bladder 14 is inward of a peripheral bonding region 86 of the sole plate 16.

The method 200 then includes step 214, securing the midsole layer 12 relative to the sole plate 16. In embodiments in which the midsole layer 12 is secured directly to the sole plate 16, such as in the sole structure 10 shown in FIGS. 9-10, step 214 includes bonding the peripheral bonding region 78 of the midsole layer 12 to the peripheral bonding region 86 of the sole plate 16. In such embodiments, the polymeric bladder 14, including its relatively narrow peripheral flange 41, is entirely inward of the peripheral bonding regions 78, 86.

In other embodiments, such as in the sole structure 110 of FIGS. 11-12, the midsole layer 12 and the sole plate 16 are secured to the peripheral flange 41 of the polymeric bladder 14. More specifically, in such embodiments, step 214 includes bonding the peripheral bonding region 78 of the midsole layer 12 to the upper side 87 of the peripheral flange 41 and bonding the peripheral bonding region 86 of the sole plate 16 to the lower side 89 of the peripheral flange 41. The method 200 may also include securing the cleats 106 to the cleat mounting features 100 and securing the sole structure 10 or 110 to the upper 23.

Accordingly, the components of both of the sole structures 10 and 110 are geometrically configured in a complementary manner to accommodate the contoured outer surfaces of the bladder 14 at the medial and lateral sides in order to allow manufacturing of each of the sole structures 10, 110 by vertically stacking and bonding the components to one another.

The following Clauses provide example configurations of a sole structure for an article of footwear disclosed herein.

Clause 1: A sole structure for an article of footwear, the sole structure comprising: a midsole layer, a sole plate, and a polymeric bladder; wherein the midsole layer has a lower surface with a first recess and a peripheral bonding region between an outer periphery of the midsole layer and an outer periphery of the first recess; the sole plate having an upper surface with a second recess, the first recess and the second recess together forming a cavity between the sole plate and the midsole layer, the upper surface of the sole plate having a peripheral bonding region between an outer periphery of the sole plate and an outer periphery of the second recess; and the polymeric bladder nested in the cavity between the midsole layer and the sole plate with a contoured upper surface of the polymeric bladder inward of the peripheral bonding region of the midsole layer and a contoured lower surface of the polymeric bladder inward of the peripheral bonding region of the sole plate.

Clause 2: The sole structure of Clause 1, wherein: the polymeric bladder has a fluid-filled interior cavity and a peripheral flange establishing at least a portion of an outer perimeter of the polymeric bladder and at least partially surrounding the fluid-filled interior cavity; and the peripheral flange is disposed between the peripheral bonding region of the midsole layer and the peripheral bonding region of the sole plate, with the peripheral bonding region of the midsole layer bonded to an upper side of the peripheral flange and the peripheral bonding region of the sole plate bonded to a lower side of the peripheral flange.

Clause 3: The sole structure of any of Clauses 1-2, wherein the peripheral bonding region of the midsole layer is bonded to the peripheral bonding region of the sole plate.

Clause 4: The sole structure of any of Clauses 1-3, wherein the contoured upper surface of the polymeric bladder is mated with the lower surface of the midsole layer in the first recess.

Clause 5: The sole structure of Clause 4, wherein: the contoured upper surface of the polymeric bladder includes a plurality of rounded protrusions; and the lower surface of the midsole layer includes a plurality of rounded concavities corresponding with the plurality of rounded protrusions.

Clause 6: The sole structure of any of Clauses 1-5, wherein the contoured lower surface of the polymeric bladder is mated with the upper surface of the sole plate in the second recess.

Clause 7: The sole structure of Clause 6, wherein the contoured lower surface of the polymeric bladder includes a plurality of domed portions, and the upper surface of the sole plate includes a plurality of rounded concavities corresponding with the plurality of domed portions.

Clause 8: The sole structure of any of Clauses 1-7, wherein the polymeric bladder includes an upper polymeric sheet and a lower polymeric sheet bonded to one another and enclosing a fluid-filled interior cavity; the sole structure further comprising: a tensile component disposed in the fluid-filled interior cavity, the tensile component including a first tensile layer secured to the upper polymeric sheet, a second tensile layer, and a plurality of tethers connecting the first tensile layer to the second tensile layer; and wherein a plurality of lower bonds joins the lower polymeric sheet to the second tensile layer and the lower polymeric sheet is displaced from the second tensile layer between at least some of the lower bonds by fluid in the fluid-filled interior cavity.

Clause 9: The sole structure of Clause 8, wherein: a plurality of upper bonds joins the upper polymeric sheet to the first tensile layer; the upper polymeric sheet is displaced from the first tensile layer between at least some of the upper bonds along a medial side of the polymeric bladder and along a lateral side of the polymeric bladder by fluid in the fluid-filled interior cavity, forming a plurality of rounded protrusions along the medial side and along the lateral side where the upper polymeric sheet is displaced from the first tensile layer; and the upper polymeric sheet is secured to the first tensile layer between the rounded protrusions along the lateral side and between the rounded protrusions along the medial side.

Clause 10: The sole structure of Clause 8, wherein: the lower surface of the midsole layer includes a plurality of rounded concavities corresponding with a plurality of rounded protrusions of the upper polymeric sheet and extending along a medial side of the polymeric bladder and along a lateral side of the polymeric bladder; and the contoured lower surface of the polymeric bladder includes a plurality of domed portions where the lower polymeric sheet is displaced from the second tensile layer by fluid in the fluid-filled interior cavity, and the upper surface of the sole plate includes a plurality of rounded concavities corresponding with the plurality of domed portions.

Clause 11: The sole structure of any of Clauses 1-10, wherein the midsole layer defines a through-hole extending through the midsole layer over the polymeric bladder.

Clause 12: The sole structure of any of Clauses 1-11, wherein the sole plate has integral cleat mounting features.

Clause 13: The sole structure of any of Clauses 1-12, wherein the sole plate has a forefoot region, a midfoot region, and a heel region, and further comprising: a forked reinforcement plate secured to the sole plate; wherein the forked reinforcement plate has a central portion, a forward medial arm, and a forward lateral arm; wherein the forward medial arm and the forward lateral arm both extend forward from the central portion; wherein the forked reinforcement plate has a rearward medial arm and a rearward lateral arm both extending rearward from the central portion; wherein the forward medial arm and the rearward medial arm border a medial side of the sole plate; and wherein the forward lateral arm and the rearward lateral arm border a lateral side of the sole plate.

Clause 14: A method of manufacturing a sole structure for an article of footwear, the method comprising: stacking a sole plate, a polymeric bladder, and a midsole layer so that the polymeric bladder is nested in a cavity formed by a first recess in a lower surface of the midsole layer and by a second recess in an upper surface of the sole plate, and with a contoured upper surface of the polymeric bladder inward of a peripheral bonding region of the midsole layer and a contoured lower surface of the polymeric bladder inward of a peripheral bonding region of the sole plate; wherein the polymeric bladder defines a sealed, fluid-filled interior cavity; and securing the midsole layer relative to the sole plate at the peripheral bonding region of the midsole layer.

Clause 15: The method of Clause 14, wherein: the polymeric bladder includes a peripheral flange establishing an outer perimeter of the polymeric bladder and at least partially surrounding the fluid-filled interior cavity; and securing the midsole layer relative to the sole plate includes bonding the peripheral bonding region of the midsole layer to an upper side of the peripheral flange and bonding the peripheral bonding region of the sole plate to a lower side of the peripheral flange.

Clause 16: The method of Clause 14, wherein securing the midsole layer relative to the sole plate includes bonding the peripheral bonding region of the midsole layer to the peripheral bonding region of the sole plate.

Clause 17: The method of Clause 14, further comprising: inflating the fluid-filled interior cavity of the polymeric bladder prior to stacking the sole plate, the polymeric bladder, and the midsole layer.

Clause 18: The method of Clause 14, further comprising: securing a forked reinforcement plate to the sole plate.

Clause 19: The method of Clause 14, further comprising: prior to stacking the sole plate, the polymeric bladder, and the midsole layer, forming the lower surface of the midsole layer with the first recess and with a plurality of concavities at which the midsole layer is configured to mate with a plurality of rounded protrusions of the contoured upper surface of the polymeric bladder; and prior to stacking the sole plate, the polymeric bladder, and the midsole layer, forming the upper surface of the sole plate with the second recess and with a plurality of concavities at which the sole plate is configured to mate with a plurality of domed portions of the contoured lower surface of the polymeric bladder.

Clause 20: The method of any of Clauses 14-19, further comprising: prior to stacking the sole plate, the polymeric bladder, and the midsole layer, forming the polymeric bladder by: disposing a tensile component between an upper polymeric sheet and a lower polymeric sheet, the tensile component including a first tensile layer, a second tensile layer, and a plurality of tethers connecting the first tensile layer to the second tensile layer; and bonding the lower polymeric sheet to the upper polymeric sheet around the tensile component, and to the second tensile layer at a plurality of bonds; wherein the lower polymeric sheet is unbonded to and displaced from the second tensile layer adjacent to at least some of the bonds by fluid in the fluid-filled interior cavity when the fluid-filled interior cavity is inflated.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear" or "footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, unless stated otherwise, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending along a length of a component. For example, a longitudinal direction of an article of footwear extends between a forefoot region and a heel region of the article of footwear. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending along a width of a component. For example, a transverse direction of an article of footwear extends between a lateral side and a medial side of the article of footwear. The transverse direction or axis may also be referred to as a lateral direction or axis or a mediolateral direction or axis.

The term "vertical" refers to a direction generally perpendicular to both the lateral and longitudinal directions. For example, in cases where a sole structure is planted flat on a ground surface, the vertical direction may extend from the ground surface upward. It will be understood that each of these directional adjectives may be applied to individual components of a sole structure. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the article of footwear is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the article of footwear in an assembled article of footwear. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A sole structure for an article of footwear, the sole structure comprising:

a midsole layer, a sole plate, and a polymeric bladder, each having a heel region, a midfoot region, and a forefoot region; wherein the midsole layer has a lower surface with a first recess and a peripheral bonding region between an outer periphery of the midsole layer and an outer periphery of the first recess;

the sole plate having an upper surface with a second recess, the first recess and the second recess together forming a cavity between the sole plate and the midsole layer, the upper surface of the sole plate having a peripheral bonding region between an outer periphery of the sole plate and an outer periphery of the second recess; and the polymeric bladder nested in the cavity between the midsole layer and the sole plate with a contoured upper surface of the polymeric bladder inward of the peripheral bonding region of the midsole layer and a contoured lower surface of the polymeric bladder inward of the peripheral bonding region of the sole plate; and wherein the contoured upper surface of the polymeric bladder includes a plurality of rounded protrusions extending along a lateral side of the polymeric bladder and extending along a medial side of the polymeric bladder with multiple ones of the rounded protrusions in each of the heel region, the midfoot region, and the forefoot region on the medial side and on the lateral side, and a substantially flat portion extending from the rounded protrusions at the lateral side to the rounded protrusions at the medial side.

2. The sole structure of claim 1, wherein:

the polymeric bladder has a fluid-filled interior cavity and a peripheral flange establishing at least a portion of an outer perimeter of the polymeric bladder and at least partially surrounding the fluid-filled interior cavity; and the peripheral flange is disposed between the peripheral bonding region of the midsole layer and the peripheral bonding region of the sole plate, with the peripheral bonding region of the midsole layer bonded to an upper side of the peripheral flange and the peripheral bonding region of the sole plate bonded to a lower side of the peripheral flange.

3. The sole structure of claim 1, wherein the peripheral bonding region of the midsole layer is bonded to the peripheral bonding region of the sole plate.

4. The sole structure of claim 1, wherein the contoured upper surface of the polymeric bladder is mated with the lower surface of the midsole layer in the first recess.

5. The sole structure of claim 4, wherein:

the lower surface of the midsole layer includes a plurality of rounded concavities extending in the heel region, the midfoot region, and the forefoot region of the midsole layer and corresponding with the plurality of rounded protrusions.

6. A sole structure for an article of footwear, the sole structure comprising:

a midsole layer, a sole plate, and a polymeric bladder, each having a heel region, a midfoot region, and a forefoot region; wherein the midsole layer has a lower surface with a first recess and a peripheral bonding region between an outer periphery of the midsole layer and an outer periphery of the first recess;

the sole plate having an upper surface with a second recess, the first recess and the second recess together forming a cavity between the sole plate and the midsole layer, the upper surface of the sole plate having a peripheral bonding region between an outer periphery of the sole plate and an outer periphery of the second recess;

the polymeric bladder nested in the cavity between the midsole layer and the sole plate with a contoured upper surface of the polymeric bladder inward of the peripheral bonding region of the midsole layer and a contoured lower surface of the polymeric bladder inward of the peripheral bonding region of the sole plate;

wherein the contoured lower surface of the polymeric bladder is mated with the upper surface of the sole plate in the second recess; and wherein the contoured lower surface of the polymeric bladder includes a plurality of domed portions extending along a lateral side of the polymeric bladder and extending along a medial side of the polymeric bladder with multiple ones of the domed portions in each of the heel region, the midfoot region, and the forefoot region on the medial side and on the lateral side, and extending transversely across the heel region from the lateral side to the medial side, and includes a substantially flat portion in the forefoot region extending from the domed portions along the lateral side to the domed portions along the medial side.

7. The sole structure of claim 6, wherein the upper surface of the sole plate includes a plurality of rounded concavities corresponding with the plurality of domed portions.

8. The sole structure of claim 1, wherein the polymeric bladder includes an upper polymeric sheet and a lower polymeric sheet bonded to one another and enclosing a fluid-filled interior cavity; the sole structure further comprising:

a tensile component disposed in the fluid-filled interior cavity, the tensile component including a first tensile layer secured to the upper polymeric sheet, a second tensile layer, and a plurality of tethers connecting the first tensile layer to the second tensile layer; and wherein a plurality of lower bonds joins the lower polymeric sheet to the second tensile layer and the lower polymeric sheet is displaced from the second tensile layer between at least some of the lower bonds by fluid in the fluid-filled interior cavity.

9. The sole structure of claim 8, wherein:

a plurality of upper bonds joins the upper polymeric sheet to the first tensile layer;

the upper polymeric sheet is displaced from the first tensile layer between at least some of the upper bonds along the medial side of the polymeric bladder and along the lateral side of the polymeric bladder by fluid in the fluid-filled interior cavity, forming the plurality of rounded protrusions along the medial side and along the lateral side where the upper polymeric sheet is displaced from the first tensile layer; and the upper polymeric sheet is secured to the first tensile layer and is substantially flat between the rounded protrusions along the lateral side and between the rounded protrusions along the medial side.

10. The sole structure of claim 8, wherein:

the lower surface of the midsole layer includes a plurality of rounded concavities corresponding with a plurality of rounded protrusions of the upper polymeric sheet and extending along the medial side of the polymeric bladder and along the lateral side of the polymeric bladder; and the contoured lower surface of the polymeric bladder includes a plurality of domed portions where the lower polymeric sheet is displaced from the second tensile layer by fluid in the fluid-filled interior cavity, and the upper surface of the sole plate includes a plurality of rounded concavities corresponding with the plurality of domed portions.

11. The sole structure of claim 1, wherein the midsole layer defines a through-hole extending through the midsole layer over the polymeric bladder.

12. The sole structure of claim 1, wherein the sole plate has integral cleat mounting features.

13. The sole structure of claim 6, further comprising:

a forked reinforcement plate secured to the sole plate; wherein the forked reinforcement plate has a central portion, a forward medial arm, and a forward lateral arm; wherein the forward medial arm and the forward lateral arm both extend forward from the central portion; wherein the forked reinforcement plate has a rearward medial arm and a rearward lateral arm both extending rearward from the central portion; wherein the forward medial arm and the rearward medial arm border the medial side of the sole plate; and wherein the forward lateral arm and the rearward lateral arm border the lateral side of the sole plate; and wherein the forward medial arm, the forward lateral arm, the rearward medial arm, and the rearward lateral arm of the forked reinforcement plate have concavities corresponding with and underlie the domed portions of the polymeric bladder extending along the lateral side of the polymeric bladder and the domed portions of the polymeric bladder extending along the medial side of the polymeric bladder.

14. The sole structure of claim 6, wherein:

the contoured upper surface of the polymeric bladder includes a plurality of rounded protrusions extending along the lateral side of the polymeric bladder and extending along the medial side of the polymeric bladder with multiple ones of the rounded protrusions in each of the heel region, the midfoot region, and the forefoot region on the medial side and on the lateral side, and a substantially flat portion in the heel region extending from the rounded protrusions at the lateral side to the rounded protrusions at the medial side; and the substantially flat portion of the contoured upper surface of the bladder directly overlies the domed portions of the contoured lower surface extending transversely across the heel region from the lateral side to the medial side.

15. A method of manufacturing a sole structure for an article of footwear, the method comprising:

forming a polymeric bladder by:

disposing a tensile component between an upper polymeric sheet and a lower polymeric sheet, the tensile component including a first tensile layer, a second tensile layer, and a plurality of tethers connecting the first tensile layer to the second tensile layer;

disposing an anti-weld material on one of the lower polymeric sheet and the second tensile layer at selected areas; and bonding the lower polymeric sheet to the upper polymeric sheet around the tensile component, and to the second tensile layer at a plurality of bonds so that the polymeric bladder defines a sealed, fluid-filled interior cavity; wherein the lower polymeric sheet is unbonded to the second tensile layer at the selected areas on which the anti-weld material is disposed and displaced from the second tensile layer adjacent to at least some of the bonds by fluid in the fluid-filled interior cavity when the fluid-filled interior cavity is inflated;

after forming the polymeric bladder, stacking a sole plate, a polymeric bladder, and a midsole layer so that the polymeric bladder is nested in a cavity formed by a first recess in a lower surface of the midsole layer and by a second recess in an upper surface of the sole plate, and with a contoured upper surface of the polymeric bladder inward of a peripheral bonding region of the midsole layer and a contoured lower surface of the polymeric bladder inward of a peripheral bonding region of the sole plate; and securing the midsole layer relative to the sole plate at the peripheral bonding region of the midsole layer.

16. The method of claim 15, wherein:

the polymeric bladder includes a peripheral flange establishing an outer perimeter of the polymeric bladder and at least partially surrounding the fluid-filled interior cavity; and securing the midsole layer relative to the sole plate includes bonding the peripheral bonding region of the midsole layer to an upper side of the peripheral flange and bonding the peripheral bonding region of the sole plate to a lower side of the peripheral flange.

17. The method of claim 15, wherein securing the midsole layer relative to the sole plate includes bonding the peripheral bonding region of the midsole layer to the peripheral bonding region of the sole plate.

18. The method of claim 15, further comprising:

inflating the fluid-filled interior cavity of the polymeric bladder prior to stacking the sole plate, the polymeric bladder, and the midsole layer.

19. The method of claim 15, further comprising:

securing a forked reinforcement plate to the sole plate.

20. The method of claim 15, further comprising:

prior to stacking the sole plate, the polymeric bladder, and the midsole layer, forming the lower surface of the midsole layer with the first recess and with a plurality of concavities at which the midsole layer is configured to mate with a plurality of rounded protrusions of the contoured upper surface of the polymeric bladder; and prior to stacking the sole plate, the polymeric bladder, and the midsole layer, forming the upper surface of the sole plate with the second recess and with a plurality of concavities at which the sole plate is configured to mate with a plurality of domed portions of the contoured lower surface of the polymeric bladder.

* * * * *